United States Patent [19]

Yasuda et al.

[11] Patent Number: 4,732,068

[45] Date of Patent: Mar. 22, 1988

[54] CUTTING DEVICE

[75] Inventors: Ryoichi Yasuda; Kazutoshi Yamada, both of Takatsuki, Japan

[73] Assignee: Omron Tateisi Electronics Co., Kyoto, Japan

[21] Appl. No.: 828,680

[22] Filed: Feb. 12, 1986

[30] Foreign Application Priority Data

Aug. 9, 1985 [JP] Japan ..... 60-123298[U]

[51] Int. Cl.[4] ..... B41J 11/70; B26D 1/09

[52] U.S. Cl. ..... 83/575; 83/695; 83/697; 83/580

[58] Field of Search ..... 83/575, 577, 519, 580, 83/388, 695, 697; 235/3

[56] References Cited

U.S. PATENT DOCUMENTS

| | | | |
|---|---|---|---|
| 873,302 | 12/1907 | Cummings | 83/211 |
| 1,367,513 | 2/1921 | Mann | 83/577 X |
| 2,244,550 | 6/1941 | Chandler | 83/386 X |
| 2,654,431 | 10/1953 | Feldhausen et al. | 83/575 X |
| 2,800,178 | 7/1957 | Taylor | 83/576 X |
| 3,533,616 | 10/1970 | Bettenhausen | 83/385 X |

*Primary Examiner*—Donald R. Schran

*Attorney, Agent, or Firm*—Stevens, Davis, Miller & Mosher

[57] ABSTRACT

A cutting device is provided for use with a printer having a plurality of movable blades which are disposed in side-by-side relationship and driven in a direction perpendicular to the length of the blade. A plurality of solenoids are provided for driving each movable blade. A spring, which is arranged to be depressed by the movement of the movable blade, applies a pressure to the paper to fix the paper in position before the movable blade reaches the cutting position.

9 Claims, 9 Drawing Figures

CUTTING DEVICE

BRIEF SUMMARY OF THE INVENTION

This invention relates to a cutting device, particularly a cutting device for cutting receipt paper of an electronic cash register.

It is well known that electronic cash registers (hereinafter referred to as ECR's) are equipped with a cutting device for cutting receipt paper. Heretofore, such devices have included a single blade for cutting the paper and a solenoid for actuating the blade. The blade is actuated by the solenoid to move backward and forward perpendicular to the direction of the blade length, thereby cutting the paper.

One type of printer previously used in ECR's generally utilizes paper having a width of 38 to 57 millimeters (mm). Accordingly, the cutting device includes a single blade with a length of 40 to 60 mm to cut such paper.

Relatively recently, the information printed on the receipt paper has been diversified to meet the various needs of the customer so that the printer must print not only the sale price but also detailed article information. ECR's employing such printers are necessarily required to utilize wide paper, e.g., 76 mm or more in width. Accordingly, a single blade cutting device applied for use with such wide paper has the following disadvantages:

(1) A large blade is required to cut such paper, which also requires a large solenoid to drive the blade. A large current must be supplied to actuate the solenoid.

(2) The shape of the blade is preferably semisquare because an elongate blade frequently causes rattling of the blade when moving in a direction perpendicular to the length of the blade. With respect to a blade having a large width and length, the mounting unit for the blade must necessarily be quite large.

(3) ECR receipt paper is first fed to a printer which prints given information thereon and then is forwarded to the cutting device. The blade of the cutting device is normally disposed over the solenoid or in a position accessible to personnel for replacement. The paper must be fed along the long path between the printer and the blade due to the large size of the solenoid which is located therebetween, which results in an unnecessarily large blank space on the fed paper.

It is, accordingly, a primary object of this invention to provide a cutting device which overcomes the above-mentioned disadvantages by providing a plurality of blades for cutting paper.

It is another object to provide a cutting device including a blade and solenoid which are reduced in size.

It is still another object to provide a cutting device for saving a current required for actuating a solenoid.

It is still another object to provide a cutting device for reducing the loss of unprinted paper.

It is a further object to provide a cutting device which allows the blade to cut the paper without displacement caused by the friction between the paper and the blade.

According to this invention, there is provided a cutting device which includes a plurality of movable blades aligned in a side-by-side relationship for cutting paper placed in the device, a plurality of solenoid members corresponding to each of said movable blades and driving said movable blades linearly, and actuating means for actuating said solenoid members.

Other objects and advantages of this invention will be apparent from the following description when considered in conjunction with the accompanying drawings.

DETAILED DESCRIPTION OF THE INVENTION

Figure 1:
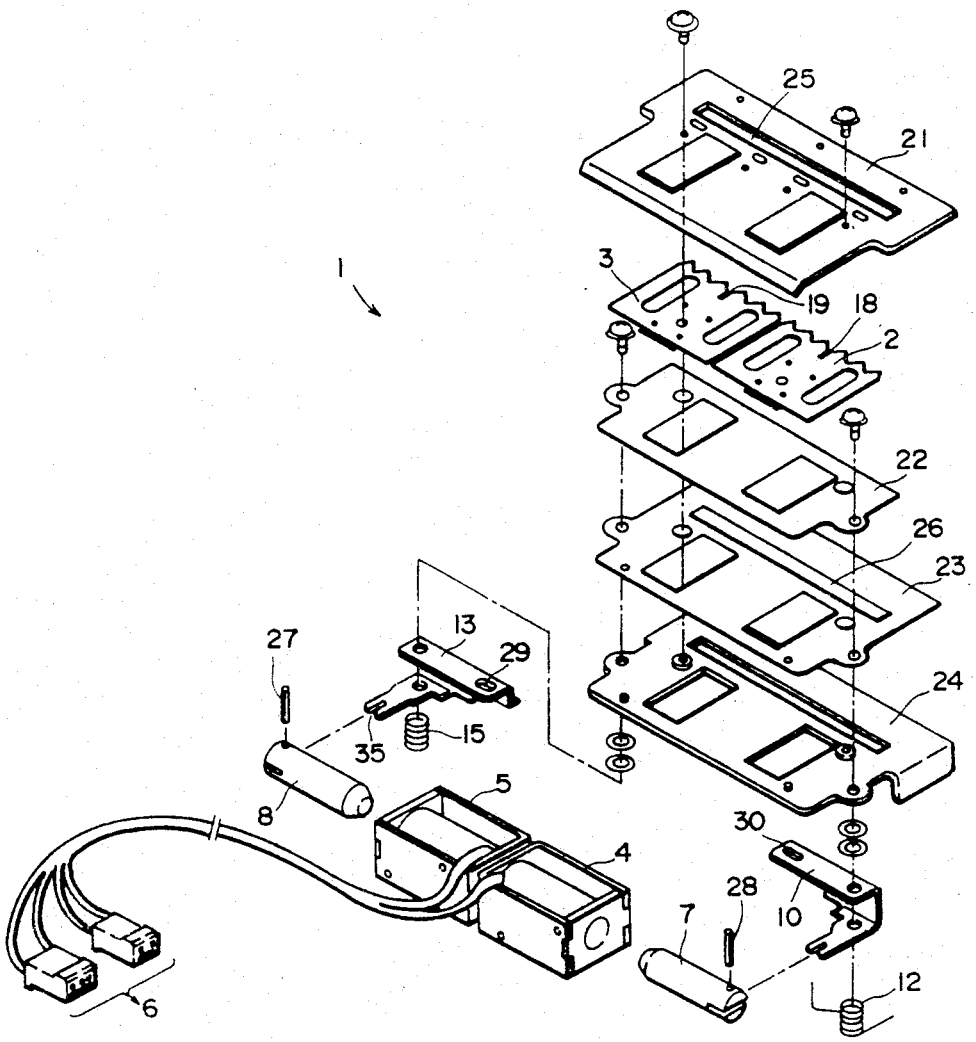
FIG. 1 is an exploded perspective view of a cutting device according to a preferred embodiment of this invention.

In FIG. 1, a cutting device 1 is shown which is fabricated by disposing a pair of movable blades 2 and 3 on the flat surface of stationary blade 23. The movable blades are driven by solenoids 4 and 5 in a direction perpendicular to the length of the blade. A spacer 22 is interposed between stationary blade 23 and movable blades 2, thereby preventing the movable blades from contacting opening 26 of stationary blade 23 when solenoids 4 and 5 are actuated. In fabrication, the stationary blade 23, spacer 22, and movable blades 2 and 3 are stacked on base member 24 in this order and then covered with cover member 21.

It is noted that the stationary blade 23 and cover member 21 are respectively formed in one piece which will ensure and facilitate the positioning of movable blades 2 and 3 interposed between stationary blade 23 and cover member 21. The cover member 21 and stationary blade 23 are secured to base member 24 with their openings 25 and 26 facing each other to allow paper to pass therethrough.

The solenoids 4 and 5 are actuated by an actuating circuit 6, thereby driving the plungers 7 and 8 to be withdrawn from their normal positions as is familiar to those skilled in the art. Pins 27 and 28 in the plungers 7 and 8 are respectively engaged with linked levers 10 and 13 which are pivotally supported on shafts 11 and 14. The linked levers 10 and 13 have slots 29 and 30 which engage with projections (not shown in FIG. 1) extending from the back surface of movable blades 2 and 3. Upon actuation of solenoid 4 or 5, the corresponding linked lever 10 or 13 engaged with the plunger thereof rotates around its associated shaft thus driving the corresponding movable blade 2 or 3.

Figure 2:
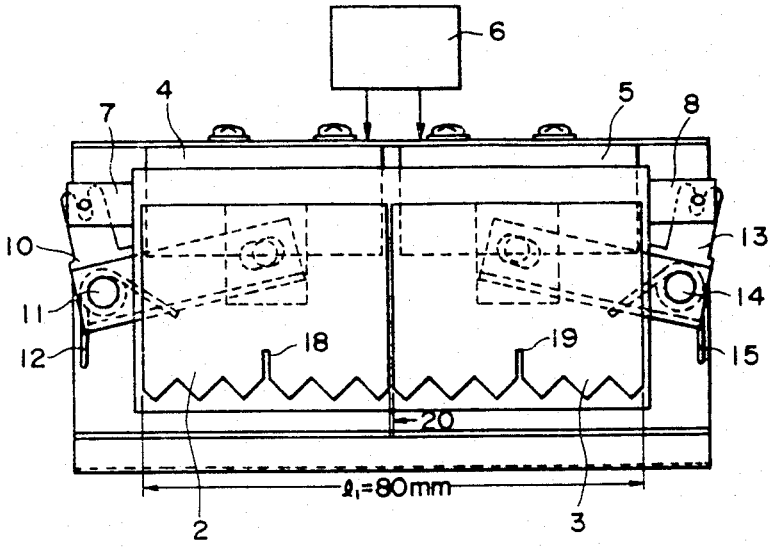
FIG. 2 is a plan view of the device of FIG. 1 illustrating both the movable blades in a normal position.

Referring to FIG. 2, the linked levers 10 and 13 are biased by springs 12 and 15 to set the movable blades in a normal position. The movable blades 2 and 3 are semisquare in shape, have slits 18 and 19 therein and are provided with a clearance 20 therebetween. Such slits and clearance will prevent the paper from being completely cut off and blown away. The overall length L1 of the blades is approximately 80 mm which enables the blades to cut paper more than 76 mm in width. The actuating circuit 6 is a previously known circuit which may comprise integrated or discrete circuits. The solenoids 4 and 5 are electrically connected to the actuating circuit which may actuate the solenoids 4 and 5 in sequence.

Figure 3:
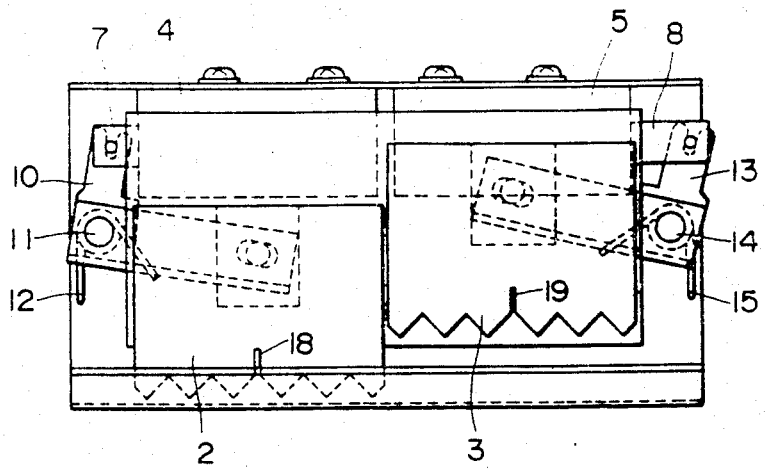
FIG. 3 is a plan view of the device of FIG. 1 illustrating a first movable blade as it is being driven.
Figure 4:
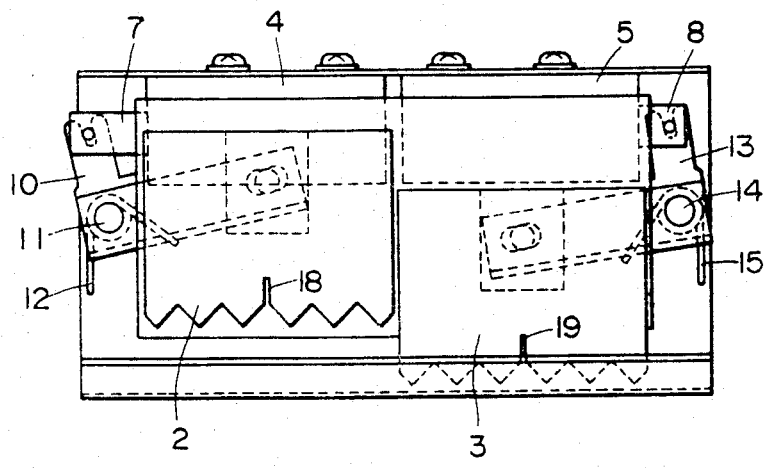
FIG. 4 is a plan view of the device of FIG. 1 illustrating a second movable blade as it is being driven.

FIGS. 3 and 4 show the manner in which movable blades 2 and 3 are alternatively driven by solenoids 4 and 5. The actuating circuit means is preferably constructed so as to provide output signals for actuating solenoids 4 and 5 alternately. In this manner, there is no need to simultaneously actuate solenoids 4 and 5, which in turn permits the use of a relatively small current in the actuating circuit.

Figure 5:
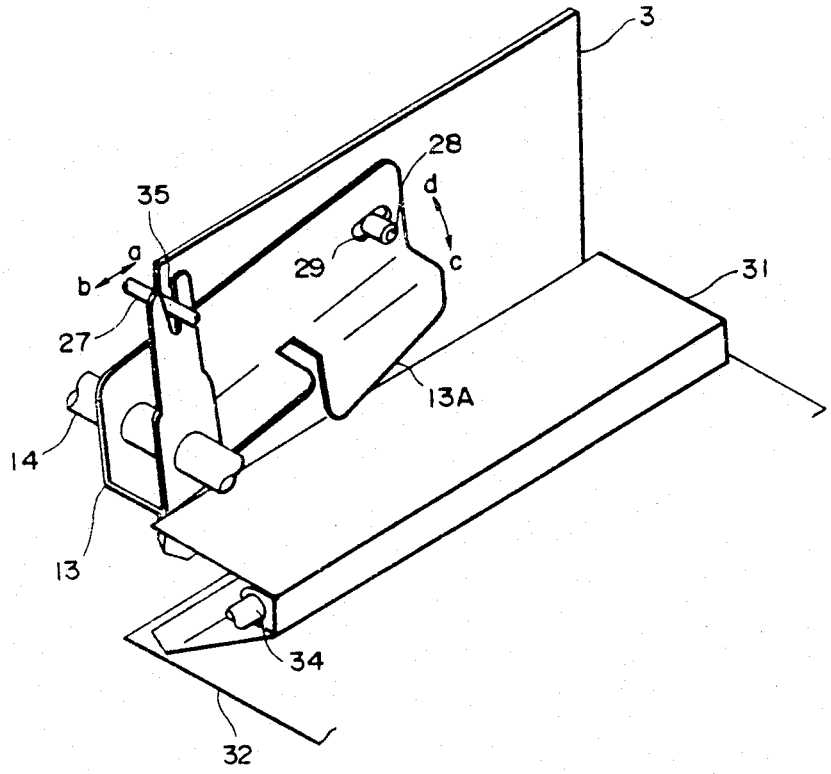
FIG. 5 is a perspective view illustrating the configuration of a spring and spring depressing means which are employed in the device of FIG. 1.

FIG. 5 shows the detailed relationship between the linked lever 13 and movable blade 3. As previously described, in response to the actuation of solenoid 5, the pin 27 moves in a direction a-b. The linked lever 13 whose slot 35 is engaged with pin 27 rotates around shaft 14 thereby driving movable blade 3 in a direction d-c through the engagement between slot 29 and projection 28 mounted on the movable blade. As the linked lever 13 rotates, its projecting portion 13A applies a depressing force to spring 31. The spring 31, when depressed, applies pressure against the paper (not shown) which is fed along table means 32. The projecting portion 13A is so inclined that its contacting area with spring 31 increases with increased rotation of the linked lever and reaches its maximum at the point where movable blade 3 cuts the paper. The position of the paper will not be displaced when the paper is being cut, because spring 31 depresses the paper against the table means 32 thereby fixing it thereon before movable blade 3 reaches the cutting position.

Figure 6A:
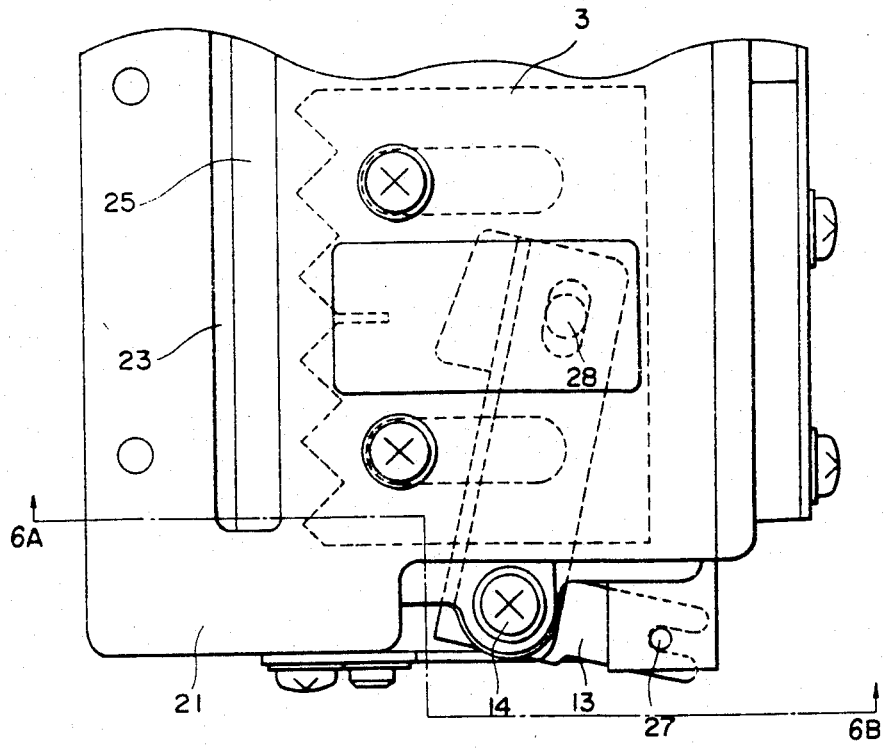
FIG. 6A is a partially enlarged plan view of the device of FIG. 1 illustrating the relationship between the movable blade in a normal position, the stationary blade, and the cover blade.
Figure 6B:
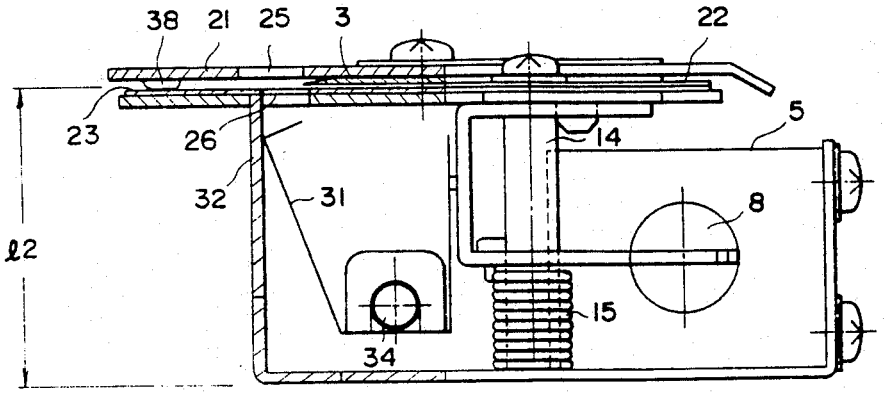
FIG. 6B is a partial sectional view showing the spring and spring depressing means in a normal position.

FIGS. 6A and 6B show the position of movable blade 3 when it is not being driven by solenoid 5. In this condition, the spring 31 is not depressed by projecting portion 13A so that the paper interposed between table means 32 and spring 31 can be fed through openings 26 and 25. The table means 32 cooperating with spring 31 function as a guide for feeding the paper while information is being printed thereon.

It is noted here that the opening 25 of cover member 21 is assembled to establish a displacement with respect to the opening 26 of stationary blade 23, thus preventing the paper from being fed into the clearance made by separator 38. In addition, the distance L2 provided from a printer (not shown) to the cutting position is relatively small because of the use of small sized solenoids so that the losses due to unprinted portions on the paper can be reduced.

Figure 7A:
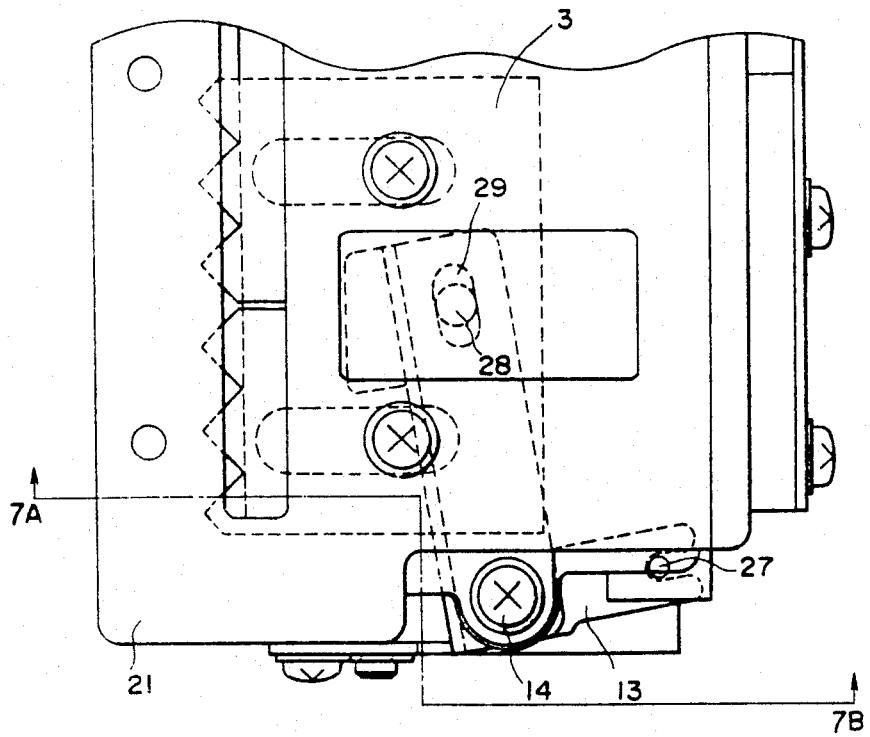
FIG. 7A is a partial plan view illustrating the relationship between the movable blade as it is being driven, the stationary blade, and the cover member.
Figure 7B:
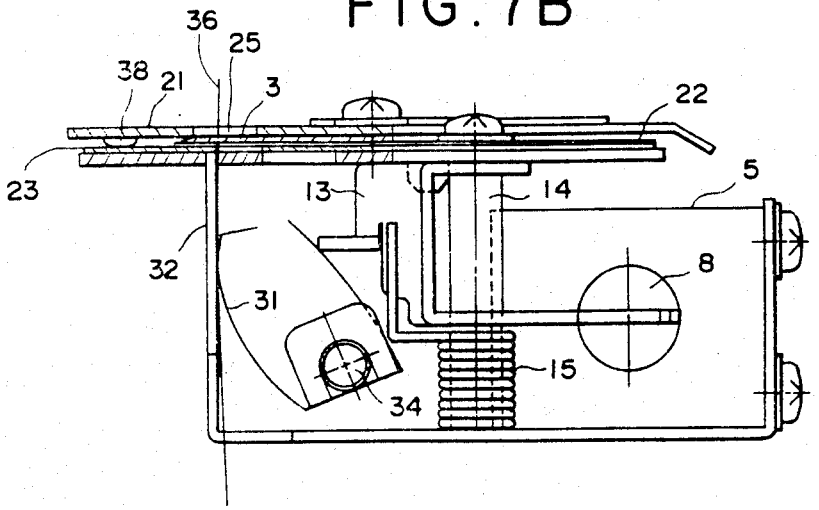
FIG. 7B is a partial sectional view showing the spring and spring depressing means with the solenoid actuated.

Upon the completion of printing, as previously described, solenoid 5 is actuated to drive movable blade 3 thereby cutting the paper 36 (FIG. 7B). Before movable blade 3 reaches the cutting position, the projecting portion 13A gradually depresses spring 31 thereby fixing the paper 36 against table means 32 (FIG. 7B). After cutting the paper, the depression of the paper by spring 31 will not be released until movable blade 3 leaves the cutting position. In this way, the top end of the paper will be prevented from being carried away by the paper due to its friction.

It will be appreciated that various modifications can be made in the above-described embodiments of the invention. For example, the number of movable blades may be chosen in accordance with the width of paper to be cut. Further, a plurality of movable blades may be driven at the same time, if current capacity permits.

The invention is not limited to the embodiments described above, but all changes and modifications thereof not constituting departures from the spirit and scope of the invention are intended to be included.

What is claimed is:

1. A cutting device, comprising:

a plurality of movable blades for cutting paper placed in said device along a cutting direction transverse to a longitudinal dimension of said paper, said movable blades being aligned in side-by-side relationship along said cutting direction;

a plurality of solenoid members, corresponding to each of said movable blades, for driving said movable blades linearly;

a stationary blade for cutting the paper in cooperation with said movable blades, said stationary blade being aligned with said movable blades in spaced side-by-side relationship along said longitudinal dimension of said paper; and actuating means for actuating said solenoid members.

2. A cutting device according to claim 1, wherein said actuating means comprises means for actuating said solenoid members in sequence.

3. A cutting device according to claim 1, wherein said movable blades include a slit for preventing the paper from being completely completely cut off.

4. A cutting device according to claim 1, wherein said stationary blade is formed in one piece and includes a first opening for cutting the paper.

5. A cutting device according to claim 1, wherein said cover member is formed in one piece and includes a second opening through which the paper is passed, said second opening being disposed with respect to said first opening to allow the paper to pass therethrough.

6. A cutting device according to claim 1, further comprising a spacer interposed between said stationary blade and said movable blades.

7. A cutting device according to claim 1, wherein said movable blades are disposed on a flat surface for cutting paper; and said cutting device further comprises table means for guiding the paper in a direction perpendicular to a direction of movement of said movable blades; spring means for pressing the paper against said table means; and spring depressing means for depressing said spring means in response to actuation of said solenoid members before said movable blades reach a position at which the paper is to be cut, and for releasing said spring means after said movable blades return from said position.

8. A cutting device according to claim 7, wherein said spring depressing means includes a projection having a profile such that a position of said projection in contact with said spring means gradually increases in response to actuation of said solenoid members.

9. A cutting device, comprising:

a plurality of movable blades for cutting paper placed in said device, said movable blades being movable linearly both forwardly and reversely along a cutting direction transverse to a longitudinal dimension of said paper, said movable blades being aligned in side-by-side relationship along said cutting direction and having a clearance therebetween;

a plurality of solenoid members, corresponding to each of said movable blades, for driving said movable blades linearly;

a plurality of pivotable linkage means pivotable in said cutting direction, each linkage means being connected with one of said movable blades, each of said solenoid members having a plunger means connected with one of said linkage means;

actuating curcuit means for selectively actuating said solenid members to drive said plunger means to pivot said linkage means forwardly to move said movable blades along said cutting direction;

a first spring means for biasing said plurality of linkage means reversely along said cutting direction to position said movable blades in a predetermined rest position;

a stationary blade aligned with said movable blades in spaced side-by-side relationship along said longitudinal dimension of said paper, for cutting the paper in cooperation with said movable blades;

a cover member in which said movable blades are slidably housed;

said stationary blade having a first opening for cutting the paper and through which the paper passes;

a spacer member interposed between said stationary blade and said movable blades and comprising means for preventing said movable blades from contacting said first opening;

a base member having said stationary blade and said spacer member mounted thereon;

a second spring means, responsive to forward movement in said cutting direction of at least one of said linkage means, for applying a pressure against said paper to secure said paper in position during a cutting operation; and said cover member including a second opening through which said paper passes, said second opening being disposed in aligned relationship with respect to said first opening to allow the paper to pass therethrough.

* * * * *